US009084471B2

(12) United States Patent
De Ricco

(10) Patent No.: US 9,084,471 B2
(45) Date of Patent: Jul. 21, 2015

(54) ORTHODONTIC TOOTHBRUSH

(71) Applicant: Salvatore P. De Ricco, West Harrison, NY (US)

(72) Inventor: Salvatore P. De Ricco, West Harrison, NY (US)

( * ) Notice: Subject to any disclaimer, the term of this patent is extended or adjusted under 35 U.S.C. 154(b) by 0 days.

(21) Appl. No.: 13/686,504

(22) Filed: Nov. 27, 2012

(65) Prior Publication Data

US 2014/0143968 A1 May 29, 2014

(51) Int. Cl.
*A46B 9/04* (2006.01)
*A46B 5/00* (2006.01)

(52) U.S. Cl.
CPC ..... *A46B 9/04* (2013.01); *A46B 5/0016* (2013.01)

(58) Field of Classification Search
CPC ..... A46B 9/04; A46B 5/0016; A46B 5/02
USPC ..... 15/167.1, 106, 110, 143.1
See application file for complete search history.

(56) References Cited

U.S. PATENT DOCUMENTS

| | | | | | |
|---|---|---|---|---|---|
| D100,558 | S | | 7/1936 | Hachman | |
| 2,095,741 | A | | 10/1937 | Hachman | |
| D107,228 | S | * | 11/1937 | Goodman | D4/112 |
| D121,437 | S | | 7/1940 | Hadden | |
| 3,934,298 | A | | 1/1976 | Kim | |
| 4,109,339 | A | * | 8/1978 | Dietrich | 15/167.1 |
| 4,150,457 | A | | 4/1979 | Larson | |
| 4,306,327 | A | * | 12/1981 | Zeski | 15/167.1 |
| 4,463,470 | A | * | 8/1984 | Willis | 15/167.1 |
| 4,542,552 | A | * | 9/1985 | d'Argembeau | 15/167.1 |
| D287,073 | S | | 12/1986 | Thompson | |
| 5,065,470 | A | | 11/1991 | Diamond | |
| 5,325,560 | A | | 7/1994 | Pavone et al. | |
| 5,345,645 | A | | 9/1994 | Page | |
| 5,398,368 | A | * | 3/1995 | Elder | 15/167.1 |
| 5,522,109 | A | * | 6/1996 | Chan | 15/106 |
| D401,418 | S | | 11/1998 | Vrignaud | |
| 5,842,247 | A | | 12/1998 | Decesare | |
| 6,230,355 | B1 | | 5/2001 | Harada | |
| 6,260,227 | B1 | * | 7/2001 | Fulop et al. | 15/167.1 |
| 6,405,401 | B1 | * | 6/2002 | Hellerud et al. | 15/167.1 |
| 6,564,416 | B1 | * | 5/2003 | Claire et al. | 15/167.1 |
| 7,992,246 | B2 | * | 8/2011 | Takeuchi et al. | 15/167.1 |
| 2004/0117930 | A1 | * | 6/2004 | Townley et al. | 15/28 |
| 2008/0301894 | A1 | | 12/2008 | Wang | |

OTHER PUBLICATIONS

Cheap Double Headed Dog Toothbrush L031D; Global Team Products (HK) Limited; 3 pages (c) 1999-2012 Alibaba.com Hong Kong Limited and Licensors.

GP Brush—Double Headed Toothbrush; (c) The Amherst Depot 1999; 2 pages; http://www.amherst-depot.com/GPBrush2.htm.

(Continued)

*Primary Examiner* — Shay Karls
(74) *Attorney, Agent, or Firm* — Maier & Maier, PLLC

(57) ABSTRACT

A toothbrush includes a handle having a gripping section, at least one arm attached to one end of the gripping section, at least one brush head attached to the at least one arm, and at least one bristle tuft extending from the brush head, wherein the bristle tuft is disposed off-perpendicular to a plane of the handle. Further, the at least one arm laterally offsets the brush head from the gripping section of the handle. In some embodiments, the toothbrush includes two arms attached to opposing ends of the gripping section of the handle, and each arm has a brush head attached thereto.

24 Claims, 7 Drawing Sheets

(56) References Cited

OTHER PUBLICATIONS

Mikki Double Ended Toothbrush—Dog Toothbrushes—Dog Dental CAre UK; (c) Groomers Limited 2012 All Rights Reserved; 2 pages; http://www.groomers-online/product.php/2368/mikki-double-ended-toothbursh.

Petrodex Double Ended Toothbrush—Cherrybrook; (c) Cherrybrook 2012; 5 pages.

International Search Report and Written Opinion of the International Searching Authority Application No. PCT/US2013/071908 Competed: Mar. 28, 2014; mailing date: Apr. 18, 2014 8 pages.

* cited by examiner

ORTHODONTIC TOOTHBRUSH

FIELD OF THE INVENTION

The invention relates to dental care and, more specifically, to a toothbrush that is adapted to provide for improved and easy brushing of gums and obstructed areas of teeth that have orthodontic braces attached, thereto.

BACKGROUND OF THE INVENTION

Orthodontic braces typically comprise brackets glued to the front of each tooth and an arch wire connecting each of the brackets. These dental devices help to improve overall dental health by aligning and straightening a person's teeth. However, braces may also contribute to dental problems. One of the most prevalent problems contributed to by braces is plaque buildup, which can lead to white-spot lesions, and further, to dental caries (i.e. tooth decay, cavities) by causing demineralization of tooth enamel. With the brackets and arch wire disposed along the facial surfaces of teeth, food becomes trapped in and around the braces. This accumulation of food allows for dental plaque to easily form. People with braces, therefore, need to practice excellent oral hygiene, in order to maintain healthy teeth and gums.

However, for many orthodontic patients, achieving the necessary oral hygiene to prevent plaque buildup is difficult, especially due to the design of braces and the patient's oral anatomy. Conventional toothbrushes are not adapted to properly clean all areas of teeth having braces. Such toothbrushes are especially unable to reach and clean regions of the teeth between the brackets and gum line (gingival region), partly because the brackets, themselves, obstruct this region. Further, the heads of conventional toothbrushes are not adapted to adequately and comfortably fit into the oral vestibule (i.e. labial and buccal vestibules) and gain access to these remote areas.

Some toothbrushes have incorporated new designs in order to promote healthier oral hygiene for orthodontic patients. For example, U.S. Pat. No. 6,260,227 to Fulop et al. discloses an orthodontic toothbrush having a linear handle attached to a large brush head with bristles extending perpendicular therefrom. The brush head includes at least five rows of bristle bundles which slope outwardly upward, producing a concave configuration adapted to encompass a bracket of the braces. However, the perpendicular bristles of the toothbrush still do not provide for improved access and cleaning of the remote regions of the teeth between the braces and gum line, especially under the bracket tie-wings. When using the traditional Bass technique of brushing, which involves directing the bristles of a toothbrush toward and into the gingival sulcus, the Fulop toothbrush as well as conventional toothbrushes cannot properly clean all areas of the braced teeth. The reason for this is the brackets of the braces prevent the bristles from penetrating and reaching areas of the teeth obstructed by the brackets, themselves. In order to achieve a satisfactory, but less than optimal, cleaning of the gingival region, the orthodontic patient must precisely angle the Fulop toothbrush in such a manner that the bristles are forced into the crevice gaps between the gums and braces. The orthodontic patient, accordingly, must position his hand and arm to perform an awkward brushing technique. Furthermore, the dimensions of the brush head with five rows of bristles make it difficult to brush the rearmost teeth (i.e. molars) where the space between the teeth (with braces attached thereto) and cheek is small. This problem is worse for children, who have smaller oral vestibules than adults. The spacing problem is also aggravated when the orthodontic patient tries angling the toothbrush such that the perpendicular bristles are oriented towards the inner crevice gaps between the gums and braces. In general, prior art orthodontic toothbrushes as well as conventional toothbrushes employed with the Bass technique fail to provide sufficient cleaning of an orthodontic patient's teeth, particularly the remote regions of the teeth between the braces and gum line.

It is therefore desired to overcome these disadvantages and provide an orthodontic toothbrush that is adapted to reach and effectively clean the gingival regions of the facial surfaces (i.e. labial and buccal surfaces) of teeth that are obstructed by braces. It is also desired to provide an orthodontic toothbrush that does not require unnatural positioning of the hand and arm to perform the brushing. It is further desired to provide an orthodontic toothbrush having one or more brush heads that are specifically configured to properly clean the top and bottom teeth, left and right of the dental midline, with braces attached thereto, without causing pain or injury to any part of the mouth.

SUMMARY OF THE INVENTION

As used herein, the term "oral vestibule" includes the labial vestibule and the buccal vestibule. Further, the term "facial surfaces" includes both labial and buccal surfaces of teeth.

It is an object of the present invention to provide an orthodontic toothbrush that complements conventional toothbrushes to achieve optimal cleaning of the facial surfaces of teeth that have braces attached thereto.

It is an another object of the present invention to provide an orthodontic toothbrush which enables proper cleaning of braced teeth in order to remove plaque buildup and to prevent dental problems.

It is also an object of the present invention to provide an orthodontic toothbrush having a handle configuration and bristle configuration that are adapted to naturally align brush head bristles away from the gum line and towards the bracket-obscured gingival regions of the facial surfaces of braced teeth. The handle configuration and bristle configuration are further adapted to orient the bristles so that they reach and effectively clean the bracket-obscured gingival regions of the facial surfaces of braced teeth.

It is also an object of the present invention to provide an orthodontic toothbrush which has one or more brush heads, each having smooth, rounded surfaces and configured for optimal cleaning of teeth with braces attached thereto.

These and other objectives are achieved by providing an orthodontic toothbrush, according to one embodiment, having a brush head adapted for fitting within all regions of an oral vestibule, wherein the base of the brush head is offset and disposed at an angle with respect to the handle. In preferred embodiments, the handle has planar surfaces and a rectangular cross section. In other embodiments, the handle has planar surfaces and a square cross section. In still other embodiments, the handle has a cylindrical shape with a circular cross section.

Other objectives are achieved by providing an orthodontic toothbrush having a handle that is configured to dispose at least one brush head in an optimal position with respect to the gingival regions of the facial surfaces of a person's teeth for cleaning.

Other objectives are achieved by providing an orthodontic toothbrush with bristle tufts that extend from the base of a brush head at an oblique angle with respect to a planar surface of the handle.

Further objectives of the present invention are achieved by providing an orthodontic toothbrush with a small, cylindrical brush head having no more than two (2) rows of bristle tufts disposed in parallel or staggered arrangement.

Additional objectives are achieved by providing an orthodontic toothbrush with a small, cylindrical brush head having a minimum number of bristle tufts in a row sufficient to properly clean the gingival regions of the facial surfaces of braced teeth.

Other objectives are achieved by providing an orthodontic toothbrush with bristles having lengths shorter than conventional toothbrush bristles (i.e. 10 mm). In some embodiments of the present invention, the bristles extend between 5 mm and 10 mm from the base of the brush head. For example, the bristles may extend 8 mm from the base of the brush head. In another example, the bristles may extend 5 mm from the base of the brush head.

Further objectives are achieved by providing an orthodontic toothbrush having a handle that is configured to dispose at least one brush head in an optimal position for cleaning the gingival regions of the lingual surfaces of a person's teeth having lingual braces attached thereto.

The orthodontic toothbrush with offset brush heads and angled bristles, according to the present invention, improves the cleaning of gingival regions of the facial surfaces of teeth that have braces, and avoids the disadvantages and inconveniences associated with prior art toothbrushes. The orthodontic toothbrush, according to the present invention, improves the manner in which braced teeth are cleaned, without requiring that the gripping and handling of the brush handle be different from traditional brushing techniques.

Still, other objectives of the present invention are achieved by providing another embodiment of the orthodontic toothbrush. In particular, the orthodontic toothbrush has a linear handle and a single brush head attached to one end of the handle, wherein bristle tufts extend from the base of the brush head at an oblique angle with respect to the surfaces of the handle.

In preferred embodiments, the brush head has a cylindrical profile with a circular cross section and a rounded, semi-spherical end, while the handle has a square cross section. With the cross sectional shape of the handle being a square, the bristles are disposed in parallel with each other and are oriented such that they form a forty-five degree (45°) angle with the longitudinal plane of at least one side/surface of the handle.

In other embodiments, the handle of the orthodontic toothbrush may comprise a cylindrical shape with a circular cross section. The bristles, in this case, are disposed in parallel with each other and are oriented such that they extend in the same direction from the brush head. More specifically, the bristles extend from the base of the brush head such that they form an angle anywhere between zero degrees (0°) and one hundred eighty degrees (180°) relative to a tangent of the surface of the circular handle.

The orthodontic toothbrush with bristles disposed in the particular configurations and positions relative to the surfaces of a linear handle, according to the present invention, improves the cleaning of gingival regions of the facial surfaces of teeth that are obscured by braces as well as avoids the disadvantages and inconveniences associated with prior art toothbrushes. The orthodontic toothbrush, according to the present invention, also improves the manner in which braced teeth are cleaned, without having to awkwardly hold and position the toothbrush within the orthodontic patient's oral vestibule. Moreover, the orthodontic toothbrush, according to the present invention, possesses structural qualities which reduce the likelihood that the toothbrush will cause pain and/or injury to the mouth during brushing of braced teeth.

Other objects of the present invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
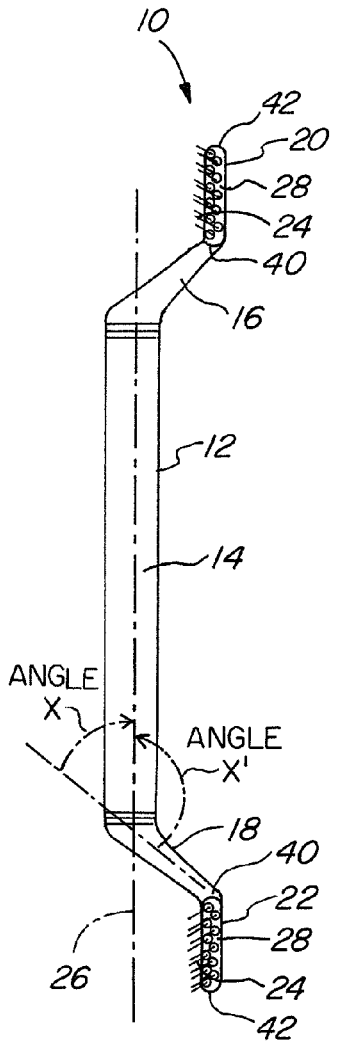
FIG. 1 is a top view of an orthodontic toothbrush with cylindrical brush heads, according to an exemplary embodiment of the present invention.
Figure 2:
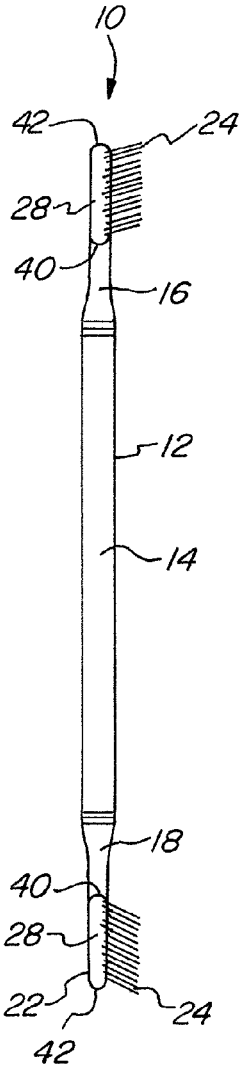
FIG. 2 is a side view of the orthodontic toothbrush of FIG. 1.
Figure 3:
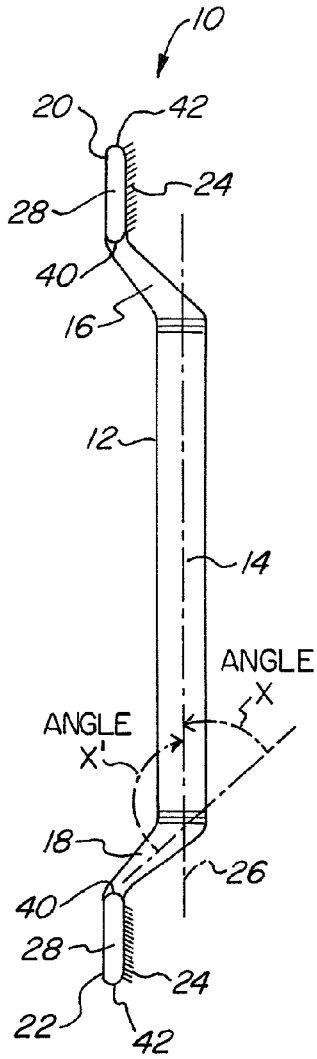
FIG. 3 is bottom view of the orthodontic toothbrush of FIG. 1.

Referring to the figures in detail and first to FIGS. 1-3, there is shown an exemplary embodiment of an orthodontic toothbrush. FIGS. 1-3 show an orthodontic toothbrush 10 having a handle 12 and brush heads 20, 22 attached to both ends of the handle 12. More specifically, the handle 12 includes a gripping portion 14 that is substantially linear and defined by a longitudinal axis 26. In a preferred embodiment, the handle 12 and gripping portion 14 have a planar shape with a rectangular cross section. The rectangular cross section of the handle 12 provides an ergonomic design for gripping and maneuvering the toothbrush 10 during a brushing session. In addition, the rectangular cross section provides a means for an orthodontic patient to grip the toothbrush so that bristles 24 are properly oriented relative to the patient's braced teeth and gum line in order to yield optimal cleaning and efficiency. Although it is preferred that the handle 12 and gripping portion 14 have a rectangular cross section, other cross-sectional shapes can be used. For example, the handle 12 and gripping portion 14 may have a planar shape with a square cross section. In another embodiment, the handle 12 and gripping portion 14 may comprise a cylindrical shape with a circular cross section. Each cross sectional design—rectangular, square, or circular—of the handle 12 ensures that the toothbrush is held properly, to achieve an optimal cleaning of the braced teeth. Moreover, each design provides a left or right handed orthodontic patient means to comfortably grip and control the toothbrush 10.

On both ends of the gripping portion 14, there are arms 16, 18, which respectively connect to the brush heads 20, 22. The arms 16, 18 both extend away in the same direction from the longitudinal axis 26 at an angle (shown as angle X or X' in FIG. 1), and thus laterally offset the brush heads 20, 22 from the gripping portion 14. For example, in some embodiments, the angle X formed between the longitudinal axis 26 and an axis defined by either arm 16, 18 can be from thirty-five degrees (35°) to ninety degrees (90°), which is equivalent to angle X' being between ninety degrees (90°) and one hundred forty five degrees (145°).

The brush heads 20, 22 each include a cylindrical base 28 having an attachment end 40 and a free end 42. The attachment end 40 is adapted to connect to either arm 16 or arm 18. In certain embodiments, the attachment ends of the brush heads are permanently connected to the arms. In other embodiments, the brush heads are detachable from the arms. The detachable feature allows the brush heads 20, 22 to be replaced if the bristles 24 (discussed further below) disposed on the cylindrical base 28 become worn from repeated brushing. The free end 42 of the base 28 has a semispherical contour comprising a round and smooth surface in order to be gentle with the tissue of the orthodontic patient's mouth during a brushing session. As such, the rounded end 42 reduces the likelihood that the toothbrush 10 will cause pain or injury to any portion of the mouth while the patient is brushing one's teeth.

Figure 4:
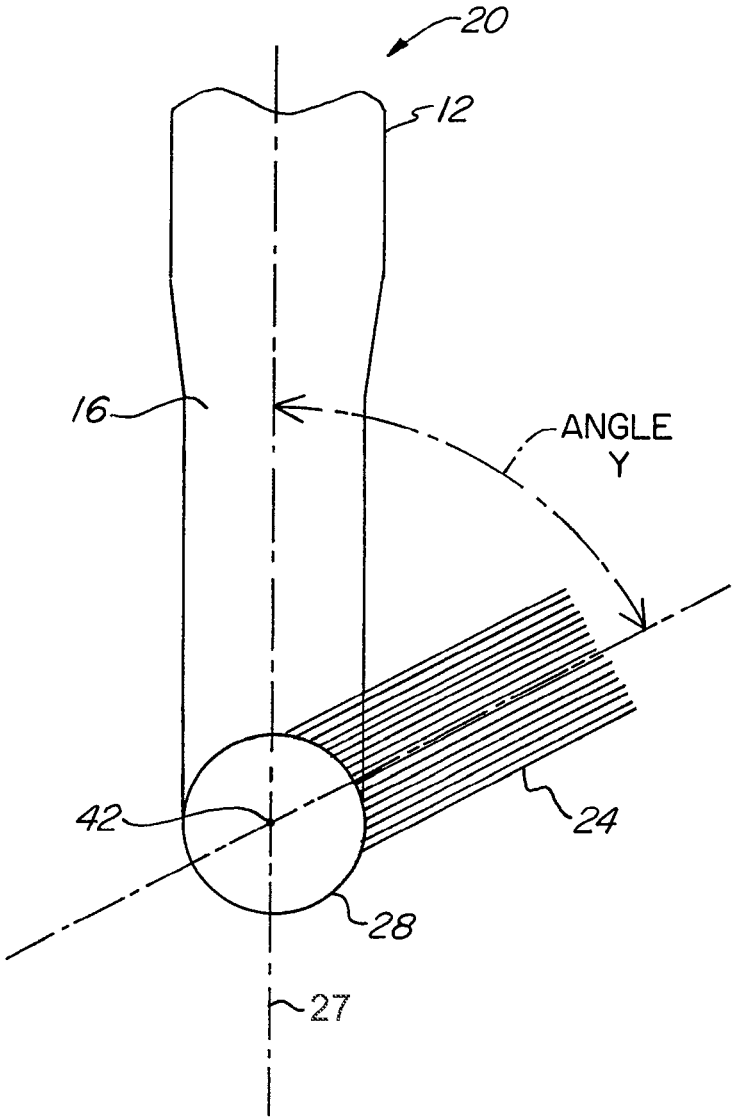
FIG. 4 is side view of the cylindrical brush head from one end of the orthodontic toothbrush of FIG. 1.
Figure 5:
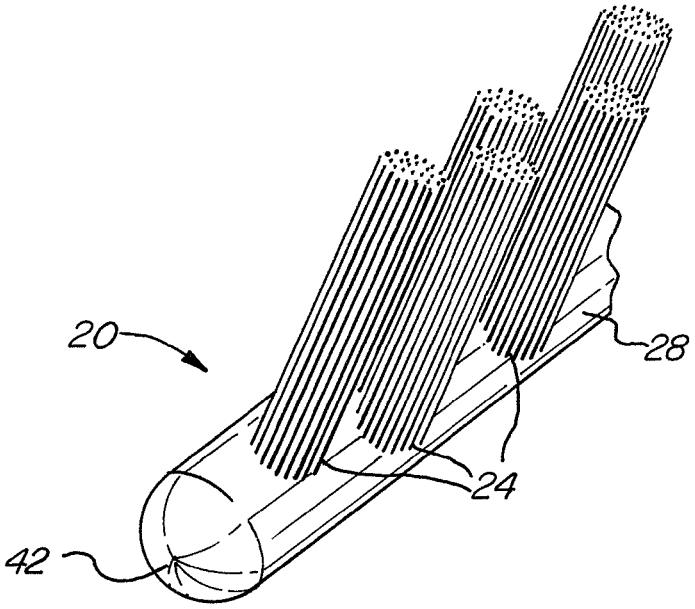
FIG. 5 is a perspective view of the brush head of FIG. 4, wherein the bristle tufts form an even cleaning surface.

The brush heads 20, 22, and, more specifically, the bristle tufts 24, disposed on the cylindrical base 28, are configured such that they are tilted with respect to the handle 12. As shown in FIGS. 4-5, the bristle tufts 24 may be oriented obliquely such that they are angled off-perpendicular (angle "Y") to a plane 27 defined by the gripping portion 14 and arms 16, 18. The longitudinal axis 26, shown in FIGS. 1 and 3, is disposed in the plane 27. In one embodiment, the bristle tufts 24 are tilted such that the angle Y is between twenty degrees (20°) and fifty degrees (50°). In a preferred embodiment, the bristle tufts 24 are configured with the angle Y being between thirty degrees (30°) and forty-five degrees (45°). The relative tilting of the brush heads and bristle tufts provide a configuration which naturally orients the bristles away from the gum line and towards the gingival regions of the teeth that are obstructed by braces.

The overall size of the brush heads 20, 22 is smaller than conventional toothbrushes. The brush heads 20, 22 are adapted to fit in all areas of the orthodontic patient's oral vestibule, including the tight spaces between the patient's rearmost teeth (i.e. molars) and cheek. Furthermore, the orthodontic toothbrush 10 with the brush heads 20, 22 can comfortably fit within a child's mouth, wherein the oral vestibule is much smaller than that of an adult. As shown in FIGS. 4-5, the design of the brush head 20, and similarly brush head 22, includes a thin cylindrical base 28 from which a plurality of bristle tufts 24 extend. Each bristle tuft has multiple bristles connected to the base 28. In one embodiment, each bristle tuft 24 forms a cylindrical shape with a circular cross section.

The bristles in each bristle tuft 24 are also adapted with different levels of hardness. For example, the bristles in one embodiment of the orthodontic toothbrush may be soft. Another embodiment of the orthodontic toothbrush may have ultra soft bristles. The soft and ultra soft bristles are preferable because they are flexible and can readily bend and reach into spaces around the braces, especially given that the bristle lengths may be shorter than those present on a conventional toothbrush.

As previously mentioned, the bristles on the brush heads 20, 22 are further adapted with respect to their orientation. In one embodiment, each bristle tuft 24 may be attached to the base 28 perpendicular to the handle 12, as typically seen in traditional toothbrushes. In a preferred embodiment, each bristle tuft 24 is disposed on the cylindrical base 28 at an oblique angle with respect to the handle 12. The angled orientation of the bristles 24 provides for optimal (maximum) contact between the bristles and the facial surfaces of teeth 32 that are typically obstructed by braces (see FIGS. 9-10). Moreover, the off-perpendicular orientation of the bristles tufts 24 provide for the bristles to point away from the gum line 32 and reach under and around the brackets 34.

The length of the bristles in each bristle tuft 24 is shorter than conventional toothbrushes. In some embodiments, the length of the bristles can be 5-10 mm. As one example, the bristles extend 8 mm from the base 28.

Each bristle tuft 24 may further be designed with different bristle tip configurations in order to provide for optimal cleaning of braced teeth. In particular, FIG. 4 illustrates a bristle configuration characterized by an even or level cleaning surface. In other words, each bristle in a bristle tuft 24 of the brush head 20 is substantially the same length.

Figure 6:
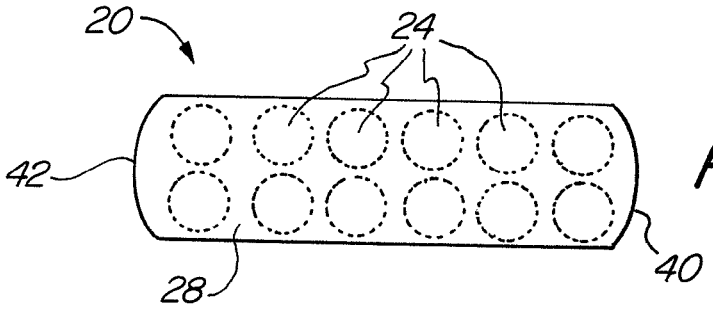
FIG. 6 is a top view of a brush head of an orthodontic toothbrush having parallel rows of bristle tufts.
Figure 7:
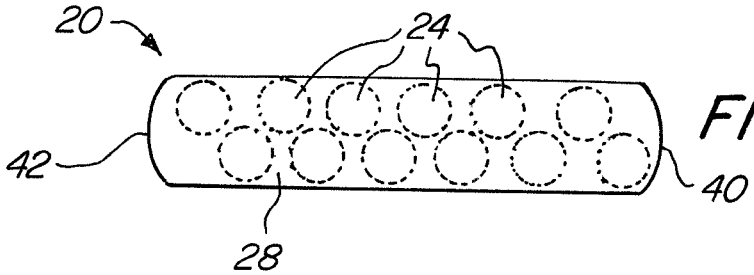
FIG. 7 is a top view of a brush head of an orthodontic toothbrush having staggered rows of bristle tufts.
Figure 8:
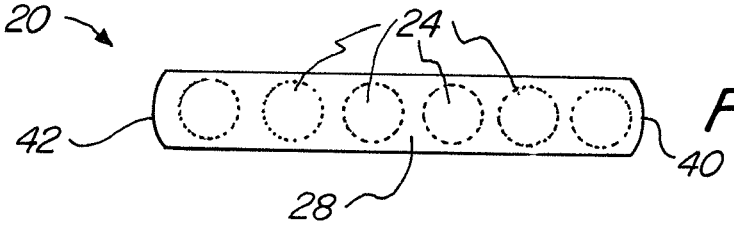
FIG. 8 is a top view of a brush head of an orthodontic toothbrush having a single row of bristle tufts.

In order to maintain a small size, the brush heads 20, 22 are configured with no more than two rows of bristle tufts 24. FIG. 6 shows one embodiment of the toothbrush where the brush head 20 has two parallel rows of bristle tufts 24. FIG. 7 shows the brush head 20 having two staggered rows of bristle tufts 24. The staggered arrangement of the bristle tufts requires less space than the parallel arrangement and thus the base 28 can be further reduced in size. Still, as shown in FIG. 8, the brush head 20 may have only one row of bristle tufts 24, which provides for the base 28 to be reduced even more in size.

The size of the brush heads 20, 22 may also be adjusted by changing the number of bristle tufts 24 present in each row. In some embodiments, there may be between four (4) and eight (8) bristle tufts in a row. FIGS. 6-8 all show an exemplary embodiment of the orthodontic toothbrush having 6 bristle tufts disposed in a row on the brush heads.

Figure 9:
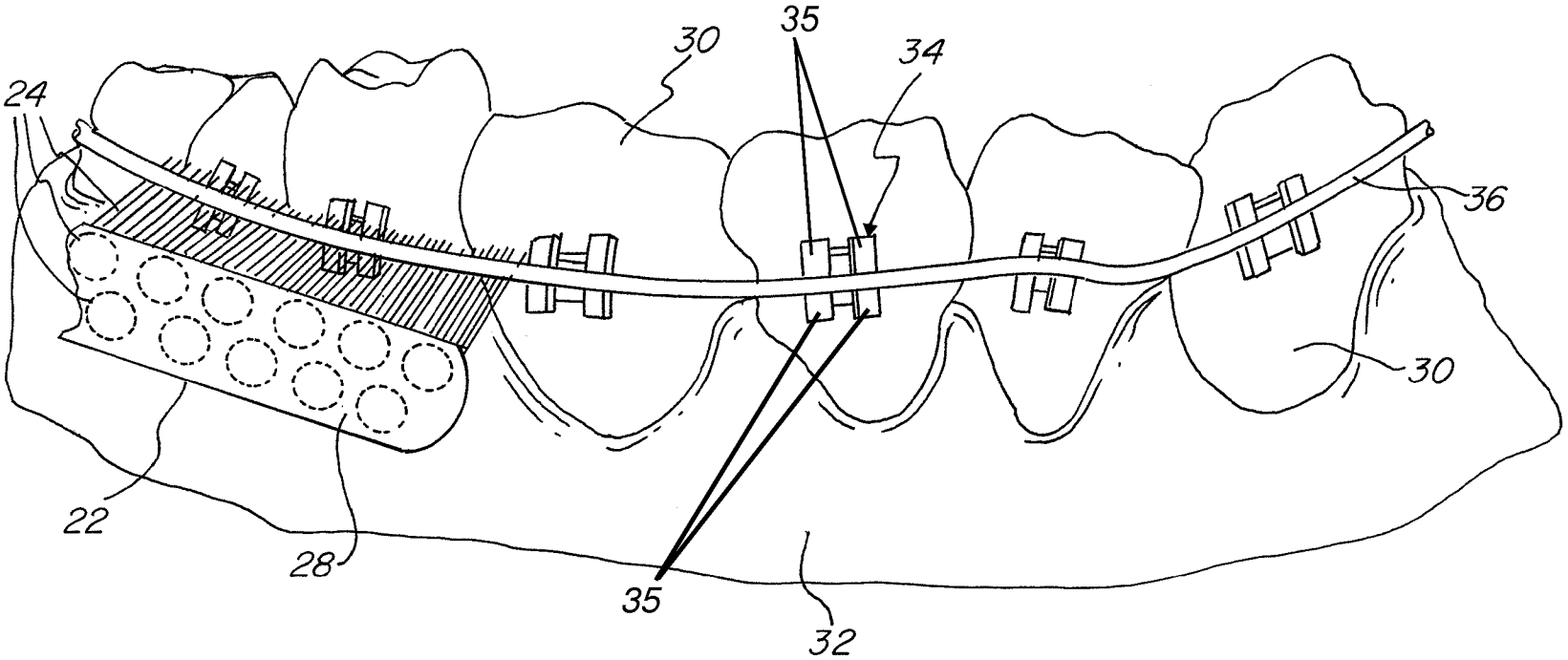
FIG. 9 is a perspective view of the orthodontic toothbrush of FIG. 1 in use, showing the divergence of bristle tufts upon contact with the gingival regions of the facial surfaces of teeth.
Figure 10:
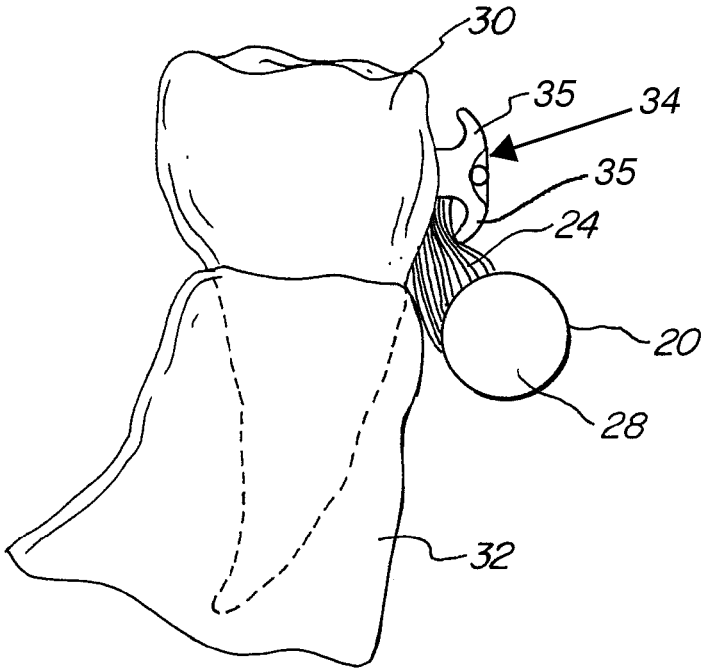
FIG. 10 is a side view of the orthodontic toothbrush of FIG. 1 in use, showing the divergence of bristle tufts upon contact with the gingival regions of the facial surfaces of teeth and their access to the areas under, and obstructed by, the bracket tie-wings of braces.

With a small cylindrical base and shorter bristles, the brush heads 20, 22 are adapted to fit in all areas of the oral vestibule, including the rear portion of the mouth between the molars and cheeks. As shown in FIGS. 9-10, the orthodontic toothbrush 10 with the above configurations of the brush heads 20, 22 provides for the bristle tufts 24 to easily reach and clean the gingival regions of the facial surfaces of teeth 30 that are obstructed by orthodontic braces (i.e. brackets 34 and arch wire 36) and tie-wings 35 (e.g., lower tie-wings) of the brackets 34. Therefore, any food that is lodged in the spaces between orthodontic braces, brackets, tie-wings and teeth as well as any existing plaque formed therein, including that which is adhered to the obscured areas of the brackets, themselves, can be removed using the orthodontic toothbrush according to the present invention.

In another embodiment of the present invention, the orthodontic toothbrush 10 is adapted to clean and access the gingival regions of the lingual surfaces of teeth obstructed by lingual braces.

The use of orthodontic toothbrush 10 is generally as follows. A user grips handle 12. Brush head 20 is used to brush the lower right portion of the mouth (from the center of the lower incisors to the rear of the lower right molars) and the upper left portion of the mouth (from the center of the top incisors to the rear of the upper left molars). Brush head 22 is used to brush the lower left portion of the mouth (from the center of the lower incisors to the rear of the lower left molars) and the upper right portion of the mouth (from the center of the top incisors to the rear of the upper right molars). Thus, the two brush heads 20, 22 are used to access and clean the mouth area which they are designed to clean. The brush heads 20, 22 will be effective for removing food particles and plaque in the difficult-to clean areas between the braces and the gum line. The movement of the orthodontic toothbrush 10, and more specifically the brush heads 20, 22, is substantially straight horizontal, as would be typical of conventional toothbrushes being used to clean teeth with or without braces.

Figure 11:
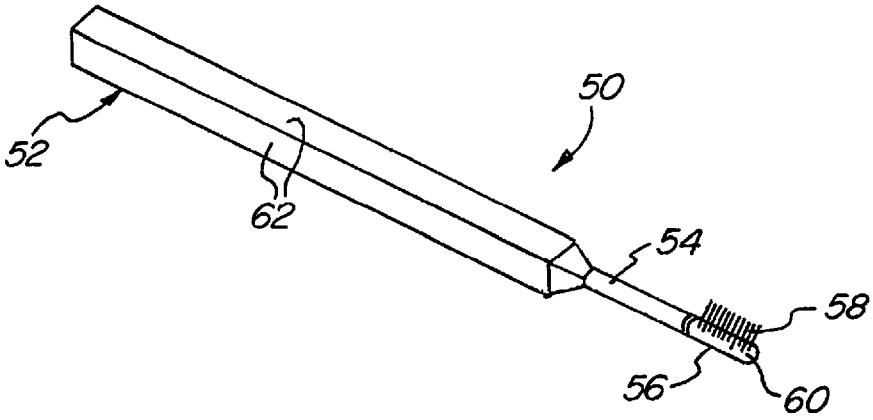
FIG. 11 is a perspective view of an orthodontic toothbrush, according to an exemplary embodiment of the present invention, having a linear handle with a square cross section and a cylindrical brush head with bristles extending therefrom such that they are oriented at oblique angles relative to surfaces of the handle.
Figure 12:
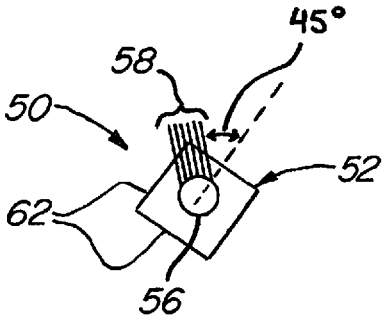
FIG. 12 is a top end view of the orthodontic toothbrush of FIG. 11.

FIGS. 11-12 show another embodiment of the orthodontic toothbrush. In particular, an orthodontic toothbrush 50 has a handle 52, an arm 54 attached to one end of the handle 52, and a brush head 56 attached to the arm 54. The brush head 56 has the same features and characteristics of the brush heads 20, 22 shown in FIG. 1. In some embodiments, the handle 52 and the arm 54 are both linear and thus collectively form a substantially linear structure. In other embodiments, however, the handle 52 and/or arm 54 may be curved to provide for additional ergonomic features to the toothbrush and to improve gripping and handling of the toothbrush. In preferred embodiments, the handle 52 has a square cross section with planar surfaces 62, as shown in FIG. 11. However, in other embodiments, the handle 52 may comprise a cylindrical shape with a circular cross section.

The arm 54 is permanently attached to one end of the handle 52. The arm 54 comprises a cylindrical shape and a circular cross section. The smooth, curved surface of the arm 54 provides for gentle contact with the tissue of the orthodontic patient's mouth during a brushing session. Further, the cross sectional profile of the arm 54 is smaller or thinner than that of the handle 52. The small cross section of the arm 54 is advantageous because the arm would take up a minimal amount of space within the patient's oral vestibule. Accordingly, the arm 54 is adapted to fit in large mouths as well as small mouths, such as a child's mouth. The small profile of the arm 54 also provides for easy maneuvering of the toothbrush 50 when the arm 54 is inserted within the patient's mouth. The end of the handle 52 attached to the arm 54 tapers towards the arm in order to provide a smooth, curved transition between the two components. This particular design feature minimizes any sharp edges on the toothbrush that may potentially come in contact with the mouth. As a result, the tapered transition between the handle and the arm reduces the likelihood that the toothbrush will cause pain or injury to the user during a brushing session.

The brush head 56 is releasably attached to the arm 54. This detachable feature of the toothbrush 50 provides for easy replacement of the brush head when the bristles 58 mounted thereon become worn from repeated brushing. As such, the orthodontic patient need not discard the entire toothbrush when the bristles become worn and can reuse the handle 52. In other embodiments, however, the brush head 56 and the arm 54 may be permanently attached to each other. Similar to the arm 54, the brush head 56 comprises a cylindrical shape and a circular cross section, as shown in FIGS. 11-12. The end of the brush head 56 is also rounded and configured with a semispherical shape. The brush head 56, accordingly, has a smooth, curved surface, which provides for gentle contact with the tissue of the orthodontic patient's mouth during a brushing session. Further, the size of the brush head 56 is smaller than the brush heads found in conventional toothbrushes. As a result, the brush head 56 is adapted to fit in all areas of the oral vestibule, especially within the tight spaces between the patient's rearmost teeth (i.e. molars) and cheek.

A plurality of bristle tufts 58 extend from the brush head 56. Each bristle tuft 58 includes multiple bristles connected to the base 60 of the brush head 56. In some embodiments, the bristles within a bristle tuft collectively form a cylindrical shape with a circular cross section. However, in other embodiments, the bristles within a bristle tuft 58 may form different cross sectional shapes other than a circle. The bristle tufts 58 are also adapted with varying levels of hardness. In particular, the level of hardness may range between soft and ultra soft. It is preferable for the bristles to have a soft or ultra soft level of hardness so that they are flexible and can readily reach into the gingival regions of the teeth that are obscured by the braces (see FIG. 10).

In general, the bristle tufts 58 are arranged in parallel with each other. Further, the bristle tufts 58 are oriented relative to the brush head 56 and the handle 52 such that, when the orthodontic patient properly grips the handle 52 and inserts the arm 54 and brush head 56 into the mouth, the bristles are automatically and naturally directed towards the gingival regions of the facial surfaces of teeth, which are obscured by the braces. Where the handle 52 has a square cross sectional shape and planar surfaces 62, the bristle tufts 58 extend from the brush head 56 such that they form an oblique angle and, more specifically, a forty-five degree (45°) angle, with the longitudinal planes of the surfaces 62 (see FIG. 12). Alternatively, where the handle 52 has a cylindrical shape and a circular cross section, the bristle tufts extend from the brush head in the same direction and in a parallel arrangement. The bristles are particularly mounted on the brush head such that they form an angle anywhere between zero degrees (0°) and one hundred eighty degrees (180°) relative to a tangent of the surface of the circular handle.

The brush head 56 may be configured with one or two rows of bristle tufts 58. By limiting the number of rows of bristle tufts, the overall size of the brush head 56 can be kept to a minimum (see FIGS. 6-8). In some embodiments, the toothbrush 50 includes two parallel rows of bristle tufts 58. In other embodiments, the toothbrush 50 has two staggered rows of bristle tufts 58. In still other embodiments, the toothbrush 50 includes only a single row of bristles tufts 58.

The number of bristle tufts 58 present in a row can vary between four (4) and eight (8). By designing the toothbrush to have a single row of 4 bristle tufts, the brush head 56 has a small size profile which still provides sufficient cleaning of the gingival regions of the facial surfaces of teeth that are obscured by braces.

In another embodiment of the present invention, the orthodontic toothbrush 50 is adapted to clean and access the gingival regions of the lingual surfaces of teeth obstructed by lingual braces.

The use of orthodontic toothbrush 50 is generally as follows. A user grips handle 52. Brush head 56 is used to brush the lower right portion of the mouth (from the center of the lower incisors to the rear of the lower right molars). Thereafter, the user adjusts his/her grip of the handle 52 by rotating the toothbrush 50 by ninety degrees (90°). The brush head 56 is then used to brush the lower left portion of the mouth (from the center of the lower incisors to the rear of the lower left molars). The user then rotates the toothbrush 50 by another ninety degrees (90°) and brushes the upper left portion of the mouth (from the center of the upper incisors to the rear of the upper left molars). The user lastly adjusts his/her grip of the handle 52 by rotating the toothbrush 50 by a further ninety degrees (90°). The brush head 56 is then oriented such that the upper right portion of the mouth (from the center of the upper incisors to the rear of the upper right molars) can be brushed. With the above-described configuration of the brush head 56, the toothbrush 50 provides an effective means for removing food particles and plaque that may build up in the gingival regions of the facial surfaces of teeth that are obscured by the braces. The movement of the orthodontic toothbrush 50, and more specifically the brush head 56, is substantially straight horizontal, as would be typical of conventional toothbrushes being used to clean teeth with or without braces.

Orthodontic toothbrush 50 may also include a cover or cap that is adapted to mount to the handle 52 and surround the arm 54, brush head 56, and bristles 58. The cover isolates the arm, brush head, and bristles from the ambient and provides sanitary protection of these components when the toothbrush is not being used. Orthodontic toothbrush 10 in FIG. 1, similarly, may have covers that are adapted to attach to the brush heads and protect them from the ambient in a sanitary manner.

Although the invention has been described with reference to particular arrangements of parts, features and the like, these are not intended to exhaust all possible designs or features.

What is claimed is:

1. A toothbrush for cleaning gums and teeth with orthodontic braces and obscured areas of the orthodontic braces, themselves, comprising:

a handle;

an arm attached to one end of the handle, said end of the handle tapering towards said arm, said arm having a cylindrical shape and substantially circular cross section;

a brush head attached to the arm, said brush head having a substantially circular cross section and a substantially dome-shaped end; and at least one bristle tuft extending from said brush head, said at least one bristle tuft is oriented oblique relative to surfaces of the handle and perpendicular to an axis of the arm and an axis of the brush head;

said at least one bristle tuft comprising a plurality of bristles, said bristles having a length shorter than 9 mm and extending from said brush head in a common direction and parallel with each other.

2. The toothbrush of claim 1, wherein said handle has a square cross section, and said bristle tuft is oriented at 45° relative to two surfaces of the handle that form the square cross section and at 135° relative to the other two surfaces of the handle that form the square cross section.

3. The toothbrush of claim 1, wherein said handle has a circular cross section and curved surfaces.

4. The toothbrush of claim 1, wherein said at least one bristle tuft comprises four or more bristle tufts disposed in a single row.

5. The toothbrush of claim 1, wherein said arm and said brush head are coaxial with said handle.

6. The toothbrush of claim 1, where the at least one bristle tuft extends 5 mm from the brush head.

7. The toothbrush of claim 1, where the at least one bristle tuft extends 8 mm from the brush head.

8. The toothbrush of claim 1, said bristles having a length shorter than 8 mm and extending from said brush head in a common direction and parallel with each other.

9. The toothbrush of claim 1, said bristles having a length shorter than about 7.5 mm and extending from said brush head in a common direction and parallel with each other.

10. The toothbrush of claim 1, said bristles having a length shorter than about 7 mm and extending from said brush head in a common direction and parallel with each other.

11. The toothbrush of claim 1, said bristles having a length shorter than about 6 mm and extending from said brush head in a common direction and parallel with each other.

12. A toothbrush for cleaning gums and teeth with orthodontic braces and obscured areas of the orthodontic braces, themselves, comprising:

a handle having a gripping section with two ends;

an arm attached to each end of the gripping section, each arm being coplanar with a longitudinal plane of the handle and laterally extending at an angle away from a longitudinal axis of the handle;

a brush head attached to each arm, each brush head being coplanar with the longitudinal plane of the handle and having a longitudinal axis parallel to the longitudinal axis of the handle; and at least one bristle tuft extending from each brush head, each bristle tuft being oriented perpendicular to the longitudinal axis of the brush head, at a substantially oblique angle relative to the longitudinal plane of the handle, and in a direction towards a plane which intersects the longitudinal axis of the handle and is orthogonal to the longitudinal plane of the handle, the at least one bristle tuft having a length shorter than 10 mm.

13. The toothbrush of claim 12, wherein each arm extends away from the longitudinal axis of said handle at an angle between 35° and 90°.

14. The toothbrush of claim 12, wherein said at least one bristle tuft of each brush head comprises a plurality of bristle tufts, said bristle tufts are substantially parallel to each other.

15. The toothbrush of claim 12, wherein said at least one bristle tuft of each brush head is oriented relative to the longitudinal plane of said handle at an acute angle between 20° and 50°.

16. The toothbrush of claim 15, wherein said acute angle is between 30° and 45°.

17. The toothbrush of claim 12, wherein said at least one bristle tuft of each brush head comprises four or more bristle tufts all disposed in a single row aligned with the longitudinal axis of the brush head.

18. The toothbrush of claim 12, wherein said at least one bristle tuft of each brush head comprises four or more bristle tufts all disposed in two rows aligned with the longitudinal axis of the brush head.

19. The toothbrush of claim 18, wherein said bristle tufts are disposed in parallel arrangement.

20. The toothbrush of claim 18, wherein the bristle tufts are disposed in staggered arrangement.

21. The toothbrush of claim 12, wherein each arm extends in the same direction and at the same angle away from the longitudinal axis of said handle.

22. The toothbrush of claim 12, wherein said handle comprises a rectangular cross section and is linear, and each brush head comprises a cylindrical shape with a circular cross section and a substantially dome-shaped end.

23. The toothbrush of claim 12, where the at least one bristle tuft extends 5 mm from the brush head.

24. The toothbrush of claim 12, where the at least one bristle tuft extends 8 mm from the brush head.

* * * * *